US006550773B2

(12) United States Patent
McKenzie et al.

(10) Patent No.: US 6,550,773 B2
(45) Date of Patent: Apr. 22, 2003

(54) COMBINATION THREE-DIMENSIONAL ARCHERY TARGET AND ANIMAL DECOY

(75) Inventors: Kevin McKenzie, Salisbury, NC (US); Mike Ingold, Salisbury, NC (US)

(73) Assignee: McKenzie Sports Products, Granite Quarry, NC (US)

( * ) Notice: Subject to any disclaimer, the term of this patent is extended or adjusted under 35 U.S.C. 154(b) by 0 days.

(21) Appl. No.: 09/829,503

(22) Filed: Apr. 10, 2001

(65) Prior Publication Data

US 2002/0145256 A1 Oct. 10, 2002

(51) Int. Cl.[7] ..... F41J 3/00; A01M 31/06
(52) U.S. Cl. ..... 273/403; 43/2
(58) Field of Search ..... 273/403, 404, 273/407, 408; 43/2, 3

(56) References Cited

U.S. PATENT DOCUMENTS

| | | | | |
|---|---|---|---|---|
| 4,203,600 A | | 5/1980 | Brown | |
| 4,477,082 A | | 10/1984 | McKenzie et al. | |
| 4,821,444 A | | 4/1989 | Remus | |
| 5,308,084 A | | 5/1994 | Morrell | |
| 5,427,382 A | | 6/1995 | Pate et al. | |
| 5,498,001 A | | 3/1996 | Franks et al. | |
| 5,503,403 A | | 4/1996 | Morrell | |
| 5,598,996 A | * | 2/1997 | Rath | 248/163.1 |
| 5,649,708 A | * | 7/1997 | Podlesny | 273/403 |
| 6,068,261 A | | 5/2000 | Nettle | |
| 6,177,043 B1 | | 1/2001 | Woock | |
| 6,254,100 B1 | * | 7/2001 | Rinehart | 273/403 |

OTHER PUBLICATIONS

McKenzie Targets (catalog) (2000).
Cabelas (catalog) p. 422 (2000).

* cited by examiner

*Primary Examiner*—Mark S. Graham
(74) *Attorney, Agent, or Firm*—Akin, Gump, Strauss, Hauer & Feld, L.L.P.

(57) ABSTRACT

A combination three-dimensional archery target and animal decoy has a first body segment which simulates the front portion of an animal, a second body segment which simulates the rear portion of the animal and a pair of replaceable middle body sections which simulate the middle portion of the animal. The replaceable middle body sections include a target middle body section and an ornamental middle body section. The combination three-dimensional archery target and animal decoy can be used as an archery target when the target middle body section is positioned between the first and second body segments and as an animal decoy when the ornamental middle body section is placed between the first and second body segments.

9 Claims, 3 Drawing Sheets

COMBINATION THREE-DIMENSIONAL ARCHERY TARGET AND ANIMAL DECOY

BACKGROUND OF THE INVENTION

The present invention is directed to archery targets and animal decoys and, more particularly, to a combination three-dimensional archery target and animal decoy, which can be used either as an archery target or as an animal decoy.

The general concept of a three-dimensional archery target having the shape of various animals for use in archery target practice is generally well known. Shooting arrows at life-sized three-dimensional animal shaped targets is a method commonly used by bow hunters to simulate actual hunting situations. Three-dimensional archery targets approximate the size and physical shape of a corresponding live animal, thereby simulating shooting at a live animal.

It is also well known to have a multi-section three-dimensional archery target in the lifelike shape of various animals having a replaceable target section. U.S. Pat. No. 4,477,082 discloses such a multi-section three-dimensional archery target and is hereby incorporated by reference. The replaceable target section generally approximates the location where a surface arrow puncture is likely to puncture the heart or lungs of the animal. The replaceable target section comprises the primary aiming point for a target archer and may be destroyed relatively quickly due to the concentration of arrow puncture and withdraw cycles in this area coupled with the aggressive arrow heads frequently used for animal hunting target practice. In contrast, non-target sections of the multi-dimensional archery target are damaged less frequently because the target shooter is generally aiming at and generally strikes the replaceable target section. Various methods and materials are used to manufacture the replaceable target section of a multi-section three-dimensional archery target while the non-target sections are generally manufactured by molding various foam materials.

If the three-dimensional archery target were constructed as a unitary assembly the entire target would have to be replaced when any section became excessively damaged to a condition where it was unusable. Typically, the target section comprising an area on the surface of the three-dimensional target where an arrow puncture will likely puncture the heart and lungs of the animal will become excessively damaged to a condition where it is unusable in such a unitary assembly. Replacement of an entire target would require an unnecessary expense to the target shooter. Using a replaceable target section with the three-dimensional archery target generally eliminates the need to replace an entire three-dimensional archery target when the target section becomes excessively damaged. An excessively damaged replaceable target section can be removed and replaced with a new replaceable target section while preserving the sections of the three-dimensional archery target which are not part of the replaceable target section and are typically not excessively damaged. Considerable expense to the target shooter is often avoided by replacing the target section of the three-dimensional archery target instead of replacing the unitarily assembled three-dimensional archery target.

In addition, animal decoys comprising various animal shapes are generally well known. Three-dimensional animal decoys generally simulate the size and shape of the animal having approximately anatomically accurate surface features. It is the goal of a three-dimensional animal decoy to attract animals. Animals are attracted to an animal decoy through natural curiosity, hunting instincts, a general social disposition and species-specific mating patterns. Specifically, deer may be attracted to a three-dimensional deer decoy due to seasonal rut patterns. The three-dimensional animal decoy is generally transported to an area where animals are likely found and is set up in that area to attract animals.

For several reasons, prior art three-dimensional archery targets are not appropriate for use as three-dimensional animal decoys. First, a three-dimensional archery target is generally constructed of a material that is heavier than the material typically used for construction of a three-dimensional animal decoy. It is preferred that the target section of a three-dimensional archery target be highly durable and, therefore, generally heavier than a comparable decoy material to enable it to withstand numerous puncture and withdraw cycles from arrows during target practice. The increased weight of the target section makes transportation of the three-dimensional archery target more difficult than transportation of a typically lighter three-dimensional animal decoy. Second, use of the three-dimensional archery target generally creates puncture marks and blemishes in the surface of the three-dimensional archery target from arrow puncture and withdraws. The presence of puncture and blemish marks on the surface of a three-dimensional archery target diminishes the lifelike appearance of the three-dimensional archery target which is desirable in a three-dimensional animal decoy. Third, it is desirable to limit the use of the target section of a three-dimensional archery target to use as an archery target. The target section of a three-dimensional archery target is generally more expensive than its decoy counterpart. Therefore, use of the target section as part of a three-dimensional animal decoy increases the opportunity for damage to occur to the relatively expensive target section during transport to or set-up in a decoy environment. Finally, three-dimensional archery targets are generally not designed to retain their ornamental surface appearance when subjected to a typical animal decoy environment. The three-dimensional animal archery target may become worn when subjected to typical decoy conditions such as direct sunlight, wind and rain.

In addition, a three-dimensional animal decoy is not appropriate for use as a three-dimensional animal archery target for several reasons. First, a three-dimensional animal decoy is not constructed of a material that is typically resilient enough to withstand numerous arrow puncture and withdraw cycles. A three-dimensional decoy is generally constructed of a material that is lightweight and easily portable by a user. The typical lightweight materials used in the construction of a three-dimensional animal decoy are quickly destroyed when struck by numerous arrows. Additionally, typical three-dimensional animal decoys are not secured to the ground such that they are able to withstand the force of an arrow striking or being withdrawn from the three-dimensional animal decoy without falling over. That is, a three-dimensional animal decoy will likely fall over when struck by the impact of a target arrow or will overturn when a target arrow is removed from its surface.

BRIEF SUMMARY OF THE INVENTION

Briefly stated, the present invention comprises a combination three-dimensional archery target and animal decoy. The combination includes a first body segment having a shape which simulates a front portion of an animal and a second body segment having a shape which simulates a rear portion of an animal. A replaceable target middle body section is matingly and detachably connected between the first and second body segments when the combination archery target and animal decoy is to be used as an archery target. The target middle body section has a shape which simulates a physiological target area of the animal and is constructed of a material that is self-healing and sufficiently resilient to enable the target portion to withstand the impact of numerous arrow puncture and withdraw cycles. A replaceable ornamental middle body section is matingly and detachably connected between the first and second body segments when the combination archery target and animal decoy is to be used as an animal decoy. The ornamental middle body section has a shape which simulates the physiological target area of the animal and is constructed of a life-like material that when attached to the first and second body segments, the combination archery target and animal decoy can be used as a decoy. The target middle body section or the ornamental middle body section is positioned between the first and second body segments depending upon whether the combination archery target and animal decoy is being used as an archery target or an animal decoy.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
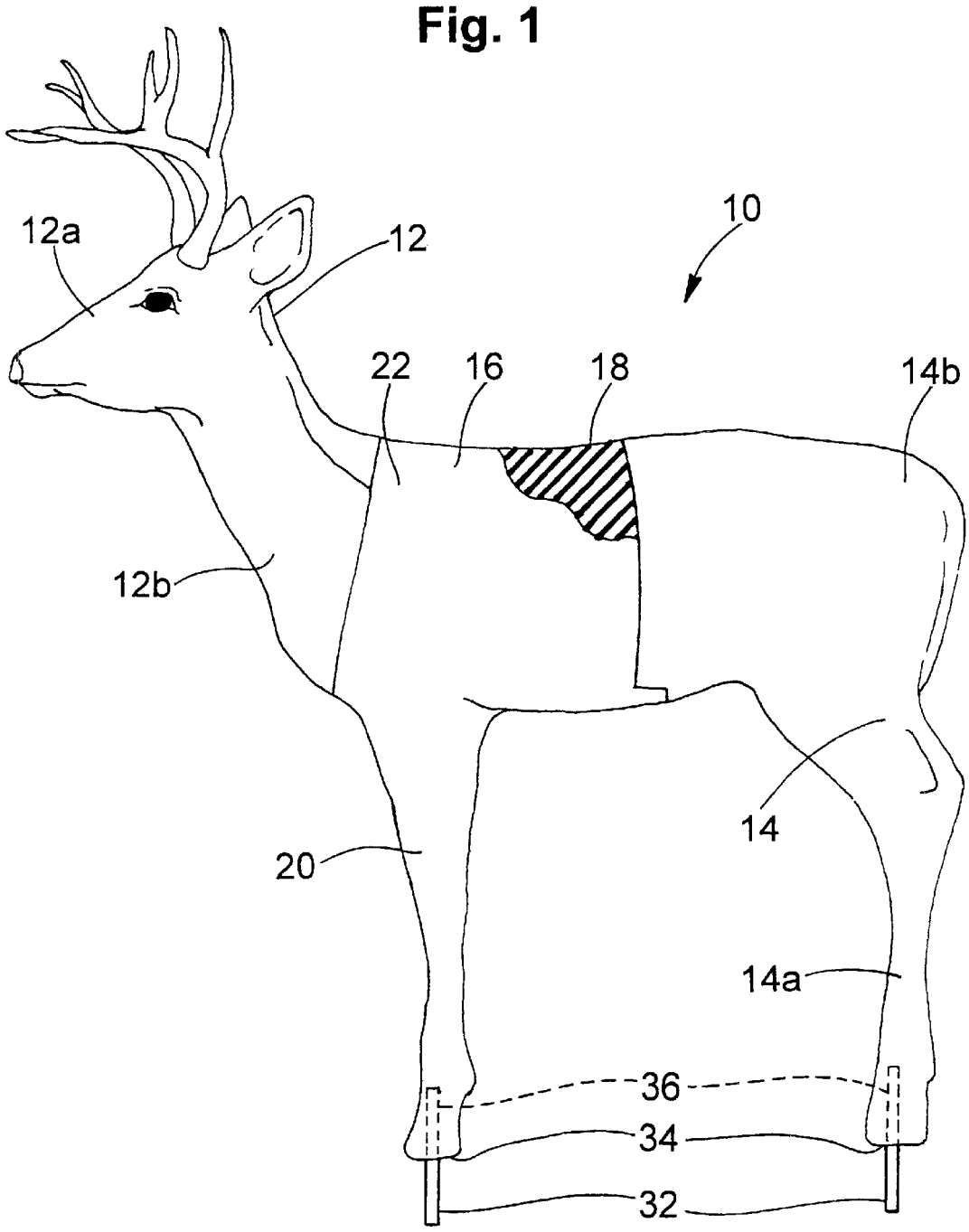
FIG. 1 is a right side elevational view of a combination archery target and animal decoy being used as a target in accordance with a preferred embodiment of the present invention.
Figure 2:
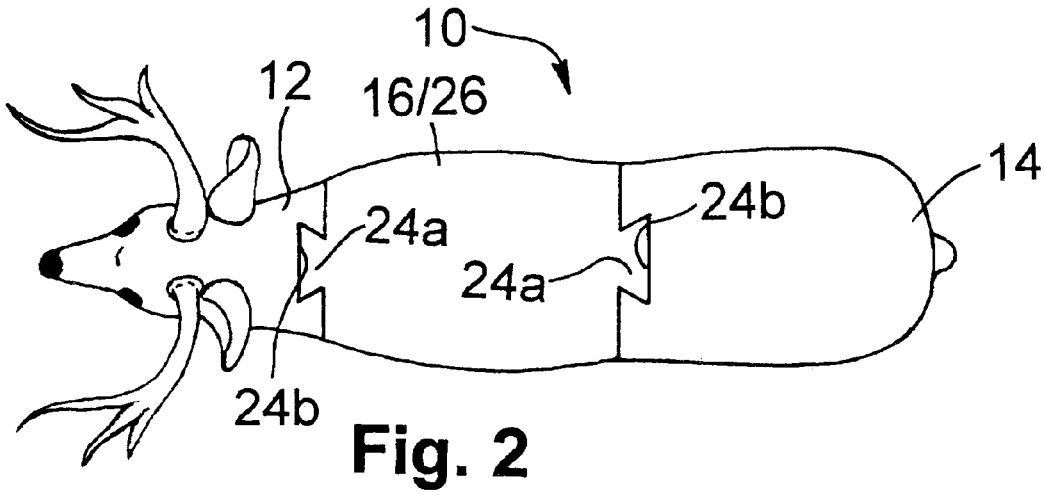
FIG. 2 is a top plan view of the combination archery target and animal decoy shown in FIG. 1.

Certain terminology is used in the following description for convenience only and is not limiting. The words "right", "left", "lower" and "upper" designate directions in the drawings to which reference is made. The words "inwardly" and "outwardly" refer to directions toward and away from, respectively, the geometric center of the combination archery target and animal decoy and designated parts thereof. The terminology includes the words above specifically mentioned, derivatives thereof and words of similar import.

Referring to the drawings in detail, wherein like numerals indicate like elements throughout, there is shown in FIGS. 1 through 4, a preferred embodiment of a combination archery target and animal decoy, generally designated 10, in accordance with the present invention. In the present embodiment, it is preferred that the combination archery target and animal decoy 10 be in the form of an animal, such as a deer. However, it is understood by those of ordinary skill in the art from the disclosure, that the present invention is not limited to a three-dimensional archery target and animal decoy 10 of any particular shape. The three-dimensional archery target and animal decoy 10 may be comprised of other animal shapes such as moose, lions, tigers, fox, pigs, leopards, impala, hyenas, bison, sheep, elk, caribou, goat, bear, wolf, coyote, alligators, antelope, bobcats, etc.

Figure 3:
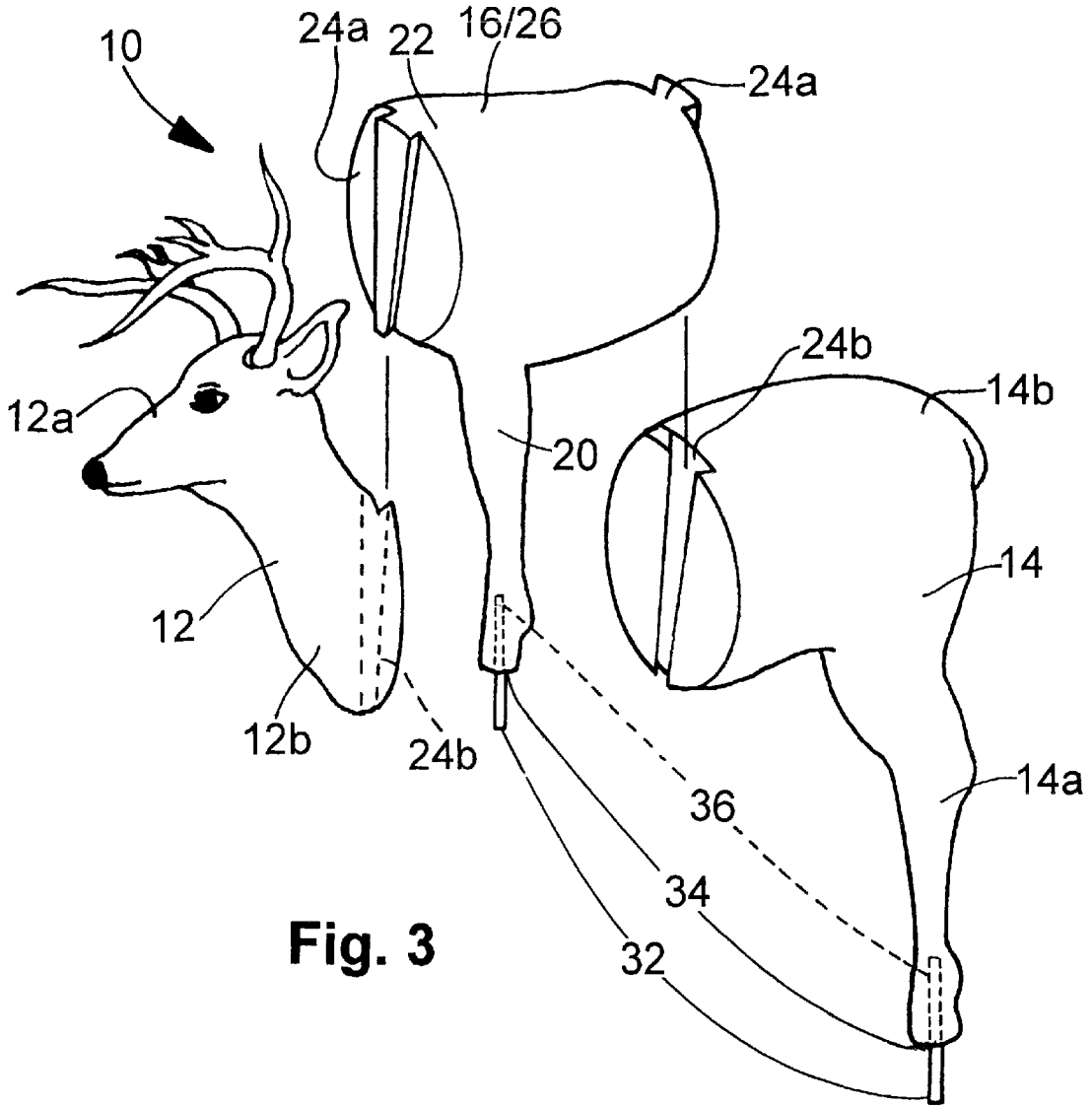
FIG. 3 is an exploded perspective view of the combination archery target and animal decoy shown in FIG. 1.

Referring now to FIGS. 1 and 3, the combination archery target and animal decoy 10 includes a first body segment 12 having a shape which simulates a front portion of an animal. More particularly, it is preferred that the first body segment 12 be in the form of an animal head 12*a* and neck 12*b*. The first body segment 12 is generally a three-dimensional front portion of an animal. The first body segment 12 is generally constructed of a material that is relatively light weight, able to take on the anatomically correct surface appearance of an animal head 12*a* and neck 12*b* and able to withstand the puncture and withdraw of an arrow with minimal damage to its external appearance. In a preferred embodiment, the first body segment 12 is comprised of a hollow polyethylene material that is flexible. In the preferred embodiment, the material of the first body segment 12 is generally able to capture and easily release an arrow from its surface by having an elasticity which allows its surface to virtually regain its original shape following capture and release of an arrow. One skilled in the art will realize that the material of the first body segment 12 is not limited to polyethylene. For example, the first body segment 12 may be constructed of a polymeric, rubber or like material which can take on the realistic surface appearance of an animal head 12*a* and neck 12*b* and is able to withstand the puncture and withdraw of an arrow without being destroyed. One skilled in the art will also realize that mass producing the first body segment 12 using a polyethylene molding process is generally less expensive than manufacturing the first body segment 12 using the foam molding process used in the prior art.

The combination archery target and animal decoy 10 includes a second body segment 14 having a shape which simulates a rear portion of an animal. More particularly, it is preferred that the second body segment 14 be in the form of an animal rear leg 14*a* and hip 14*b*. The second body segment 14 is generally a three-dimensional rear portion of an animal. In a preferred embodiment, the second body segment 14 is generally constructed of a material that is relatively light weight, able to take on the anatomically correct surface appearance of an animal head 12*a* and neck 12*b* and able to withstand the puncture and withdraw of an arrow with minimal damage to its external appearance. In the preferred embodiment, the second body segment 14 is comprised of a hollow polyethylene material that is self-healing. The self-healing material is generally able to self-heal after an arrow has punctured and been withdrawn from its surface by having an elasticity which allows its surface to virtually regain its original shape. One skilled in the art will realize that the material of the second body segment 14 is not limited to polyethylene and can be constructed of a rubber, polymeric or like material which can take on the realistic shape of an animal rear leg 14*a* and hip 14*b* and is able to withstand the puncture and withdraw of an arrow without being destroyed. One skilled in the art will also realize that mass producing the second body segment 14 using a polyethylene molding process is generally less expensive than manufacturing the second body segment 14 using the foam molding process used in the prior art.

The combination archery target and animal decoy 10 includes a replaceable target middle body section 16 matingly and detachably connected between the first body segment 12 and the second body segment 14 when the combination archery target and animal decoy 10 is to be assembled as an archery target. The replaceable target middle body section 16 has a shape, which simulates a physiological target area of the animal. The replaceable target middle body section 16 is constructed of a material 18 that is self healing and sufficiently resilient to enable the replaceable target middle body section 16 to withstand the impact of numerous arrow puncture and withdrawal cycles. More particularly, it is preferred that the replaceable target middle body section 16 be in the form of an animal front leg 20 and shoulder 22. The replaceable target middle body section 16 is generally a three-dimensional middle portion of an animal.

In the preferred embodiment, the replaceable target middle body section 16 is constructed of a solid polyurethane material which is able to take on the appearance of the surface of an animal front leg 20 and shoulder 22 and is able to withstand the impact of numerous arrow puncture and withdraw cycles. One skilled in the art will realize that the material of the target middle body section 16 is not limited to a solid polyurethane material but may be comprised of any material that is able to withstand the impact of numerous arrow puncture and withdraw cycles and take on the shape of an animal front leg 20 and shoulder 22. One skilled in the art will also realize that the target middle body section 16 may be comprised of only the target area of a subject animal which is generally composed of an area on a surface of the animal where an impacting arrow is likely to strike and puncture the heart and lungs of the subject animal.

Referring to FIG. 3, the replaceable target middle body section 16 is releasably and detachably secured to the first body segment 12 and the second body segment 14 with a pair of dovetail connections 24. Each dovetail connection 24 is generally comprised of a male dovetail or finger connection 24*a* protruding from either end of the replaceable target middle body section 16 which is accepted into a corresponding female or slot dovetail connection 24*b* on each of the first body segment 12 and the second body segment 14. Those skilled in the art will realize that while it is preferred that the male dovetail or finger connections 24*a* protrude from either end of the target middle body section 16 and are accepted into the female dovetail connections 24*b* on each of the first body segment 12 and the second body segment 14, alternate fastening arrangements are feasible. For example, the male dovetail connections 24*a* can also protrude from each of the first body segment 12 and the second body segment 14 and attach to female dovetail connections 24*b* on either end of the target middle body section 16. Additionally, those skilled in the art will realize that the first body segment 12 and the second body segment 14 can be secured to the target middle body segment 16 by other means including, but not limited to, alternate mechanical fastening or clamping methods and the like.

The target middle body section 16 may take on various forms. For example, the front animal leg 20 may be comprised of a different material than other portions of the target middle body section 16 and may be detachable from the target middle body section 16. One skilled in the art will also realize that the target middle body section 16 may be constructed of a number of materials in various sections. For example, the front leg 20 of a three dimensional archery target may be constructed of a material that is different than the material of the shoulder 22 of an animal of the target middle body section 16 which is also different than the material of attached dovetail connections 24. Such a construction would likely isolate relatively expensive self-healing materials to areas of the target middle body section 16 where an arrow is likely to strike while less expensive and less durable material could be used for areas of the target middle body section 16 where an arrow is not likely to strike.

Figure 4:
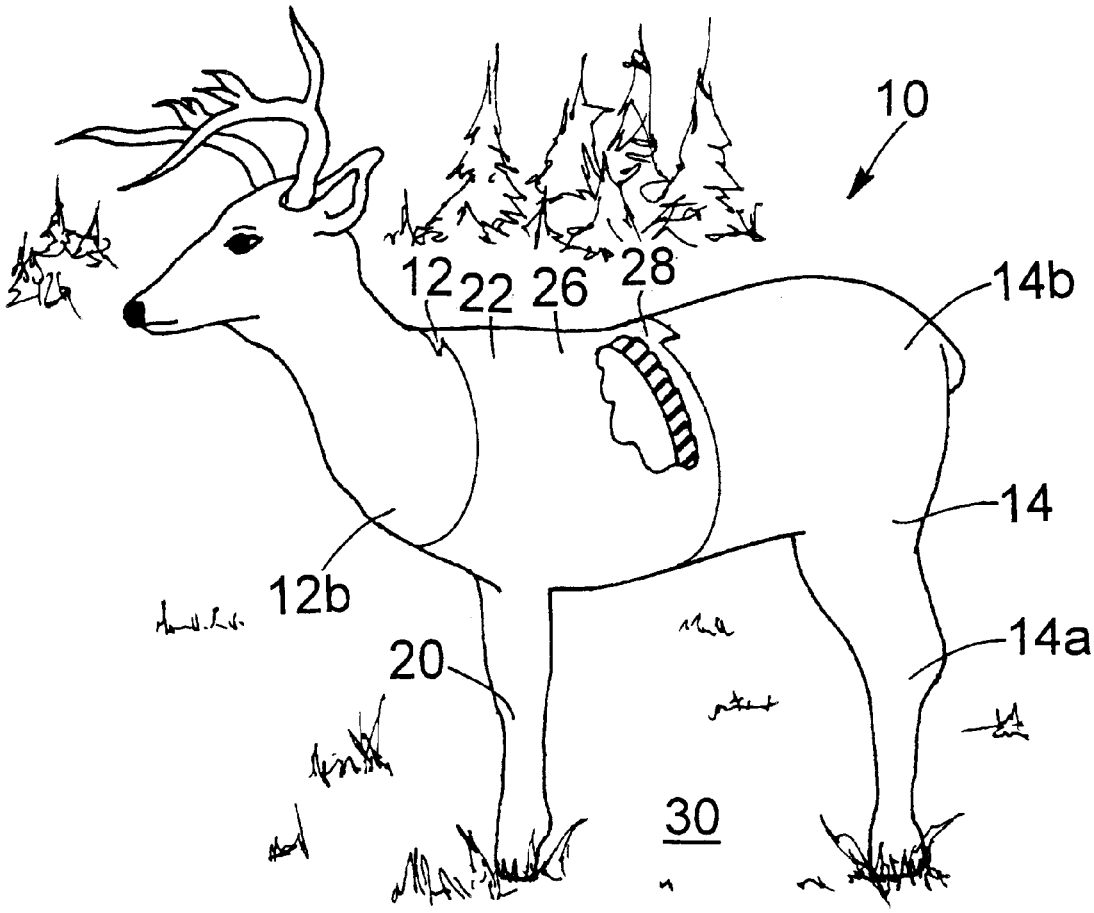
FIG. 4 is a right side perspective view of a combination archery target and animal decoy being used as an animal decoy.

Referring now to FIGS. 3 and 4, the combination archery target and animal decoy 10 includes an ornamental middle body section 26 for being matingly and detachably connected between the first body segment 12 and the second body segment 14 when the combination archery target and animal decoy 10 is used as an animal decoy. The ornamental middle body section 26 has a shape which simulates the physiological target area of the animal. The combination archery target and animal decoy 10 can be used as a decoy when the ornamental middle body section 26 is attached to the first body segment 12 and the second body segment 14. Attachment of the first and second body segments 12 and 14 to the ornamental middle body section 26 is accomplished using a generally equivalent attachment scheme as used when attaching the first and second body segments 12 and 14 to the target middle body section 16 as discussed above. More particularly, it is preferred that the ornamental middle body section 26 be in the form of a front animal leg 20 and shoulder 22. The ornamental middle body section 26 is generally a three-dimensional middle portion of an animal having the generally anatomically accurate surface appearance of the animal, as shown in FIG. 4.

In the preferred embodiment, the ornamental middle body section 26 is constructed of a hollow rubber material 28 or a like material, which improves transportability of the ornamental middle body section 26. Transportability of the combination archery target and animal decoy 10 when assembled as a decoy is improved because the ornamental middle body section 26 is comparatively lighter than the target middle body section 16 in the preferred embodiment.

In a second preferred embodiment, the ornamental middle body section 26 is comprised of a hollow polyethylene material 28. Those skilled in the art will realize that the ornamental middle body section 26 is not limited to constructions comprising hollow rubber or polyethylene materials. The ornamental middle body section 26 may be comprised of, but not limited to, polymeric or like material which is able to assume a generally anatomically accurate surface appearance of the animal, attach to the first and second body segments 12 and 14 and be durable enough to withstand a hunting environment without significant degradation to its surface appearance.

Referring to FIG. 3, either the target middle body section 16 or the ornamental middle body section 26 is positioned between the first body segment 12 and the second body segment 14 depending on whether the combination archery target and animal decoy 10 is being used as an archery target or as an animal decoy. Using the generally equivalent attachment permits the target middle body section 16 and the ornamental middle body section 26 to be interchangeable with the first and second body segments 12 and 14. Interchangeability of the target middle body segment 16 and the ornamental middle body segment 26 is an important advantage that the combination archery target and animal decoy 10 has over the prior art. Interchangability allows a user to purchase a single combination archery target and animal decoy 10 for use as a target and a decoy while the prior art necessitated the purchase of a three-dimensional archery target and a separate three-dimensional animal decoy.

The combination archery target and animal decoy 10 is fixed to a support surface 30 such as the ground, regardless of whether it is used as an archery target or as an animal decoy. A set of support shafts 32 extend from a terminal end 34 of a front animal leg 20 and rear animal leg 14*a* for being releasably positioned within the support surface 30. A void 36 is provided in the terminal ends 34 of the front animal leg 20 and the rear animal leg 14*a*, which receives a respective support shaft 32. The support shafts 32 are generally solid elongated rods comprised of a steel, wood or like material that is rigid enough to be driven into a support surface 30 a sufficient distance to prevent a typical archery or decoy conditions from overturning the combination archery target and animal decoy 10 during use. In the preferred embodiment, the support shaft 32 which mates with the target middle body section 16 is force fit into the void 36 in the terminal end 34 of the front animal leg 20 after the support shaft 32 has been secured in the support surface 30. The support shafts 32 which mate with the ornamental middle body section 26 and the second body segment 14 are permanently fixed or molded into the void 36 in the front animal leg 20 or the rear animal leg 14*a* in the preferred embodiment.

Referring to FIGS. 1 and 4, when being used as an archery target, the combination archery target and animal decoy 10 is assembled using the first body segment 12, the second body segment 14, and the target middle body section 16. The first body segment 12 and the second body segment 14 engage the target middle body section 16 through the dovetail connections 24 or alternate fastening means discussed above.

The combination three-dimensional archery target and animal decoy 10 assembled as an archery target is secured to the support surface 30 in an area appropriate for target practice. In the preferred embodiment, when used as an archery target, a support shaft 32 of the target middle body section 16 is driven, and rigidly fixed into the support surface 30 prior to engagement with the void 36 in the terminal end 34 of the front animal leg 20. However one skilled in the art will realize that the support shaft 32 may be permanently fixed into the void 36 in the front animal leg 20 prior to fixing them into the support surface 30. In the preferred embodiment, the support shaft 32 is driven approximately nine inches into the support surface 30 and is accepted approximately nine inches into the void 36 in the terminal end 34 of the front animal leg 20. This configuration of the support shaft 32 provides sufficient stability to prevent the target middle body section 16 from falling over during use.

When assembled as a target, the second body segment 14 is secured to the support surface by pressing the shaft 32 of the second body segment 14, which is permanently fixed in the void 36 in the terminal end 34 of the rear animal leg 14*a* into the support surface 30. In the preferred embodiment, the support shaft 32 is pressed into the support surface 30 approximately six inches and is fixed in the rear animal leg 14*a* with a terminal end extending approximately six inches into the rear animal leg 14*a*. One skilled in the art will realize that the support shaft 32 may be separately fixed into the support surface 30 and then slid into the void 36 in the rear animal leg 14*a* similar to the procedure used to secure the front animal leg 20 to the support surface 30 discussed above. Additionally, one skilled in the art will realize that the support shaft 32 may be driven into the support surface 30 or may extend into the void 36 in the rear animal leg 14*a* at various depths, providing the combination archery target and animal decoy 10 is secured from falling over during normal archery target use.

Once the combination three-dimensional archery target and animal decoy 10 assembled as an archery target is fixed to a support surface 30, a target archer preferably shoots arrows at the target middle body section 16 of the combination three-dimensional archery target and animal decoy 10. Upon striking the target middle body section 16 with any number of arrows, the archer is able to remove the arrows from the self-healing material 18 of the target middle body section 16 with minimal damage inflicted upon the target middle body section 16. The combination three-dimensional archery target and animal decoy 10 is generally not disturbed by removal of numerous arrows.

Referring to FIG. 4, when used as an animal decoy, the combination three-dimensional archery target and animal decoy 10 is assembled using the first body segment 12, the second body segment 14, and the ornamental middle body section 26. The first body segment 12 and the second body segment 14 engage the ornamental middle body section 26 through the dovetail connections 24 or alternate fastening means discussed above. Fastening of the ornamental middle body section 26 to the first body segment 12 and the second body segment 14 is generally accomplished using a generally equivalent fastening arrangement used to secure the target middle body section 16 to the first and second body segments 12 and 14 discussed above.

The three-dimensional archery target and animal decoy 10, assembled as a decoy, is generally secured to a support surface 30 in an area appropriate for attracting animals. In the preferred embodiment, when used as an animal decoy, the support shafts 32 of the ornamental middle body section 16 and the second body segment 14 are rigidly fixed into the terminal ends 34 of the front animal leg 20 and the rear animal leg 14*a*. A terminal end of the support shafts 32 are permanently fixed in the voids 36 of front animal leg 20 and the rear animal leg 14*a* approximately six inches from the terminal ends 32 of the front and rear animal legs 20 and 14*a*. The opposite terminal ends of the shafts 32 generally protrude from the terminal ends 34 of the front and rear animal legs 20 and 14*a* approximately six inches in the preferred embodiment.

The three-dimensional archery target and animal decoy 10 is preferably secured to the support surface 30 by driving the support shafts 32 into the support surface 30 until the terminal ends 34 of the front and rear animal legs 20 and 14*a* are flush with the support surface. Assembled as a decoy, the support shafts 32 of the three-dimensional archery target and animal decoy 10 protrude into the support surface 30 approximately six inches. This configuration of the support shafts 32 provides sufficient stability to prevent the combination three-dimensional archery target and animal decoy 10 from falling over during use as a decoy. One skilled in the art will realize that the support shafts 32 may be separately fixed into the support surface 30 and then slid into the voids 36 in the front and rear animal legs 20 and 14*a* similar to the preferred procedure used to secure the front animal leg 20 of the target middle body section 16 to the support surface 30 discussed above. Additionally, one skilled in the art will realize that the support shafts 32 may be driven into the support surface 30 or fixed in the front or rear animal legs 20 and 14*a* at various depths providing the combination archery target and animal decoy 10 is secured from falling over during normal animal decoy use.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A combination three-dimensional archery target and animal decoy comprising:

a first body segment having a shape which simulates a front portion of an animal;

a second body segment having a shape which simulates a rear portion of an animal;

a replaceable target middle body section matingly and detachably connected between said first and second body segments when the combination archery target and animal decoy is to be used as an archery target, said target middle body section having a shape which simulates a physiological target area of said animal and being constructed of a material that is self-healing and sufficiently resilient to enable said target middle body section to withstand an impact of numerous arrow puncture and withdraw cycles; and a replaceable ornamental middle body section for being matingly and detachably connected between said first and second body segments when the combination archery target and animal decoy is to be used as an animal decoy, said ornamental middle body section having a shape which simulates a physiological target area of said animal and being constructed of a less durable, life-like material such that when attached to said first and second body segments the combination archery target and animal decoy can be used as a decoy wherein one of said target middle body section and said ornamental middle body section is positioned between said first and second body segments depending upon whether said combination archery target and animal decoy is being used as an archery target or an animal decoy.

2. The combination according to claim 1 wherein said first and second body segments are releasably secured to said target middle body section and said ornamental middle body section with dovetail connections.

3. The combination according to claim 1 wherein a set of support shafts extend from a terminal end of a front leg and rear leg of said animal for being releasably positioned within a support surface to secure the combination archery target and animal decoy to said support surface.

4. The combination according to claim 3 wherein a void is provided in said terminal ends of said front and rear legs which receives a respective support shaft.

5. The combination according to claim 1 wherein said first body segment is in a form of an animal head and neck.

6. The combination according to claim 1 wherein said second body segment is in a form of a rear animal leg and hip.

7. The combination according to claim 1 wherein either said middle body section is in a form of a front animal leg and shoulder.

8. The combination according to claim 1 wherein said ornamental middle body section is comprised of a hollow rubber material.

9. The combination according to claim 1 wherein the archery target and animal decoy is in the form of a deer.

* * * * *